US005115278A

United States Patent [19]

Maruta et al.

[11] Patent Number: 5,115,278

[45] Date of Patent: May 19, 1992

[54] HEATING APPARATUS USING LOW RESISTANCE FILM

[75] Inventors: Hidekazu Maruta, Hachioji; Hiroyuki Adachi; Akira Yamamoto, both of Tokyo; Shigeo Kimura, Yokohama; Kensaku Kusaka, Kawasaki, all of Japan

[73] Assignee: Canon Kabushiki Kaisha, Tokyo, Japan

[21] Appl. No.: 542,018

[22] Filed: Jun. 22, 1990

[30] Foreign Application Priority Data

Jun. 22, 1989 [JP] Japan ..... 1-160276

[51] Int. Cl.[5] ..... G03G 15/20

[52] U.S. Cl. ..... 355/285; 219/216

[58] Field of Search ..... 355/282, 285, 289, 290, 355/286, 287, 295, 283, 284; 219/216; 430/98, 99, 100, 124

[56] References Cited

U.S. PATENT DOCUMENTS

| | | | |
|---|---|---|---|
| 3,810,735 | 5/1974 | Moser | 219/216 X |
| 3,811,828 | 5/1974 | Ohta et al. | 219/216 X |
| 4,073,583 | 2/1978 | Teumer et al. | 355/285 X |
| 4,132,882 | 1/1979 | Endo et al. | 219/216 |
| 4,438,321 | 3/1984 | Moraw | 219/216 |
| 4,566,783 | 1/1986 | Schwierz et al. | 355/289 |
| 4,596,920 | 6/1986 | Inagaki | 219/216 |
| 4,780,742 | 10/1988 | Takahashi et al. | 355/290 |
| 4,842,944 | 6/1989 | Kuge et al. | 355/285 X |
| 4,954,845 | 9/1990 | Yano et al. | 355/290 |

*Primary Examiner*—A. T. Grimley
*Assistant Examiner*—Sandra L. Brasé
*Attorney, Agent, or Firm*—Fitzpatrick, Cella, Harper & Scinto

[57] ABSTRACT

A heating apparatus for heating a visualized image on a recording material includes a stationary heater; a film in sliding contact with the heater, wherein the recording material has a visualized image which is heated through the film by heat from the heater; wherein the film comprises plural layers each having a volume resistivity of not more than $10^{11}$ ohm.cm; and a device for maintaining a potential of one of the layers contactable with the film substantially at a predetermined level.

17 Claims, 7 Drawing Sheets

HEATING APPARATUS USING LOW RESISTANCE FILM

FIELD OF THE INVENTION AND RELATED ART

The present invention relates to a heating apparatus for fixing a visualized image by heating through a film or for improving an image quality by heating.

In a widely used conventional image fixing apparatus wherein the toner image is fixed on the recording medium supporting an unfixed toner image, the recording material is passed through a nip formed between a heating roller maintained at a predetermined temperature and a pressing or back-up roller having an elastic layer and press-contacted to the heating roller.

In place of the conventional fixing system U.S. Pat. Ser. Nos. 206,767, (abandoned in favor of continuation application U.S. Ser. No. 668,333, filed Mar. 14, 1991)387,970, now U.S. Pat. No. 4,954,845, 409,431, 416,539, now U.S. Pat. No. 4,998,121, 426,082, now U.S. Pat. No. 5,026,276, 435,427, 440,380, 440,678, 444,802, 446,449 now U.S. Pat. No. 5,027,160, 496,957, 502,223 propose an image fixing apparatus having a fixed heater and a heat-resistive fixing film in a sliding contact with the heater, wherein the toner image is fused through the film.

Because the new fixing apparatus using the stationary heater and a thin film has small thermal capacity, the electric power consumption and the waiting period before the start of the operation can be reduced.

However, the flexible film used in the heating film type is made of polyimide resin or fluorinated resin or the like having a high volume resistivity.

In this case, the film is triboelectrically charged by the friction with the heater and the recording material when the film rotates. Alternatively, it is charged by the electric charge of the charged recording material or the charged toner particles on the recording material. If this occurs, the toner image is disturbed by the charging, for example, the toner is easily offset or scattered. In addition, leakage can easily occur.

The problems are particularly remarkable when the film is endless.

It is considered that the film is given a laminated structure in which the surface layer has a low resistivity. However, even in that case, the toner offset and the toner scattering can occur when the image fixing operation is continuously performed.

SUMMARY OF THE INVENTION

Accordingly, it is a principal object of the present invention to provide a film heating apparatus which does not produce toner offset or toner scattering.

It is another object of the present invention to provide a heating film and a heating apparatus using the film, wherein the film comprises plural layers having low resistivities.

It is a further object of the present invention to provide a heating apparatus wherein the surface of the film is maintained at a predetermined potential.

These and other objects, features and advantages of the present invention will become more apparent upon a consideration of the following description of the preferred embodiments of the present invention taken in conjunction with the accompanying drawings.

DESCRIPTION OF THE PREFERRED EMBODIMENTS

Figure 2:
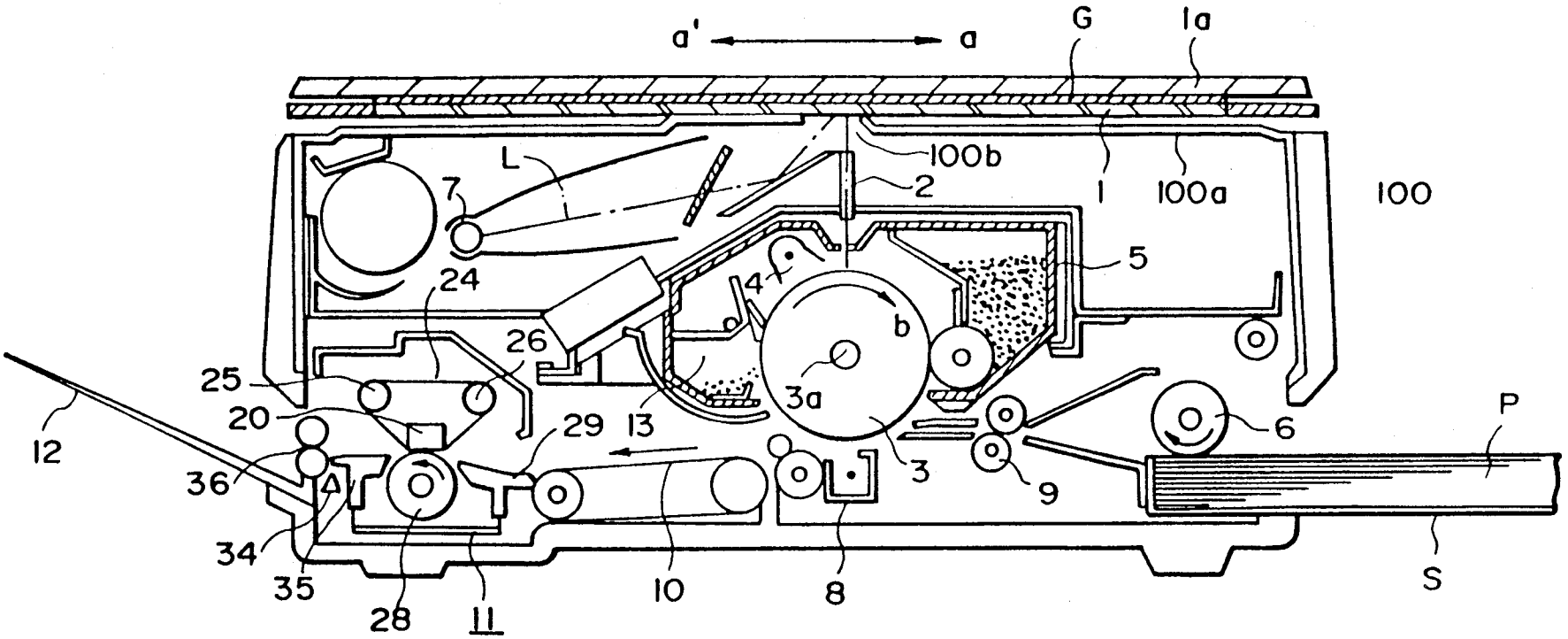
FIG. 2 is a sectional view of a copying apparatus using the fixing apparatus of FIG. 1 embodiment.

Referring to FIG. 2, the apparatus comprises a housing 100, a reciprocable original supporting platen 1 made of transparent member such as glass plate disposed on the top plate 100*a* of the housing 100, wherein the original supporting platen 1 is reciprocable rightwardly (a) and leftwardly (a') on the top plate 100*a* at predetermined speeds.

An original G is placed face down on the original supporting platen 1 at a predetermined placing reference, and is covered by an original cover 1*a*.

A slit opening 100*b* is formed on the top plate 100*a* extending in a direction perpendicular to the reciprocable movement direction of the original supporting platen (perpendicular to the sheet of the drawing). The slit constitutes a part of the original illuminating system. The face-down image surface of the original G placed on the original supporting platen 1 passes by the slit opening 100*b* during the movement of the original supporting platen 1 toward the right side (a). During the passage, the light L of the lamp 7 illuminates the original G through the slit opening 100*b* and the transparent original supporting platen 1. The light reflected by the original is imaged on the surface of the photosensitive drum 3 through an array 2 of imaging elements having a short focus and a small diameter.

The photosensitive drum 3 is coated with a photosensitive layer such as zinc oxide photosensitive layer or an organic photoconductor photosensitive layer. It is rotatable about a central axis 3*a* at a predetermined peripheral speed in the clockwise direction (b). During the rotation, the photosensitive drum 3 is uniformly charged to a positive or negative polarity by a charger 4, and the uniformly charged surface is exposed to the image light of the original through the slit opening, so that an electrostatic latent image corresponding to the light image is sequentially formed on the surface of the photosensitive drum 3.

The electrostatic latent image is visualized into a toner image with heat-softening or heat-fusing resin or the like (for example, toner powder) by the developing device 5, and the visualized toner image is conveyed to the image transfer station having the transfer discharger 8.

The transfer material sheets P are contained in a cassette S. The sheet is singled out from the cassette by rotation of a pick-up roller 6 and is fed to the photosensitive drum 3 in such a timed relationship that when the leading portion of the toner image formed on the drum 3 reaches the transfer discharger 8, the leading edge of the transfer sheet P reaches the position between the transfer discharger 8 and the photosensitive drum 3. By the transfer discharger 8, the toner image is sequentially transferred onto the fed sheet from the photosensitive drum 3.

The sheet having received the toner image is sequentially separated from the surface of the photosensitive drum 3 by an unshown separating means and is introduced by a conveying device 10 to an image fixing apparatus 11, where the unfixed toner image is heat-fixed. Thereafter, it is discharged onto the discharge tray outside the apparatus as a final print (copy) by a guide 35 and discharging rollers 36.

On the other hand, the surface of the photosensitive drum 3 having been subjected to the toner image transfer operation is cleaned by the cleaning device 13 so that the residual toner or other contamination are removed to prepare for the next image forming operation.

Figure 1:
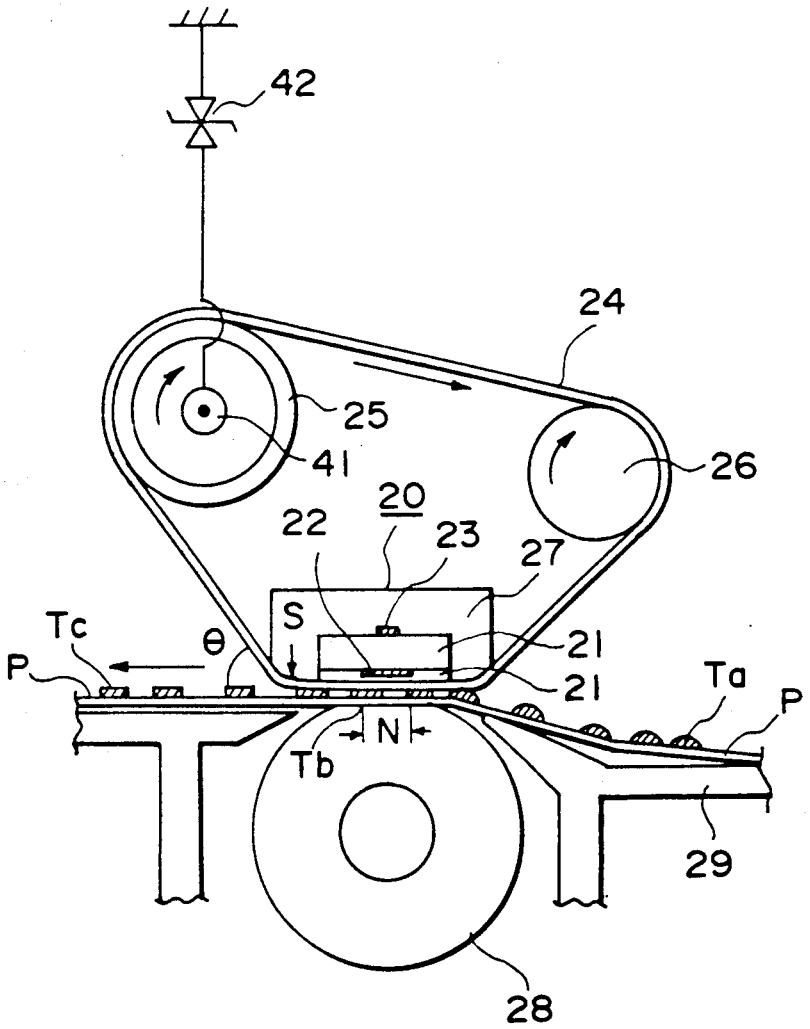
FIG. 1 is a sectional view of an image fixing apparatus according to an embodiment of the present invention.

Referring to FIG. 1, the description will be made as to an image fixing apparatus according to an embodiment of the present invention. FIG. 1 is an enlarged sectional view thereof.

An image fixing film 24 is in, the form of an endless belt, and is stretched around four parallel members, i.e., a driving roller (left side) 25, a driven roller (right side) 26, a linear heater 20 which has a low thermal capacity and which is disposed at a lower position between said driving roller 25 and the driven roller 26 and a heater supporting member 27. The fixing film 24 will be described in detail hereinafter.

The driven roller or follower roller 26 functions also as a tension roller for the endless fixing film 24. When the driving roller 25 rotates in the clockwise direction, the fixing film 24 rotates also in the clockwise direction at a predetermined peripheral speed, that is, the same speed as the conveying speed of the transfer sheet P conveyed from the image forming station 8 and carrying thereon an unfixed toner image Ta, without speed difference, without producing creases and without snaking motion.

A pressing roller (pressing member) 28 has a rubber elastic layer made of rubber material having good parting property such as silicone rubber. It is urged, by unshown urging means, toward the bottom surface of the heater 20 with the total pressure of 4-7 Kg with the bottom travel of the fixing film 24 sandwiched therebetween. The pressing roller 28 rotates in the counter-clockwise direction, that is, in the same peripheral movement direction as the transfer sheet P.

The heater 20 having the low thermal capacity and having the linear shape, in this embodiment, comprises the heater supporting member 27 extending in the direction of the width of the fixing film 24 (perpendicular to the movement direction of the fixing film 24). The supporting member has sufficient rigidity, heat-resistivity and heat-insulation properties. The heater 20 also comprises a heater base 21 mounted on the bottom surface of the supporting member 27 and extended along the length of the supporting member 27. The heater base is provided with a heat generating resistor element 22 generating heat by electric power supplied thereto.

The heater supporting member 27 functions to support the heater 20 on the fixing apparatus, and therefore, on the image forming apparatus with sufficient thermal insulation. Examples of usable materials for the heater supporting member 27 are high heat-resistivity resins such as PPS (polyphenylenesulfide), PAI (polyimide amide), PI (polyimide), PEEK (polyether ether ketone) or liquid crystal resins, or composites of such a resin and ceramic material, metal, glass or the like.

The heater base 21 has, for example, an alumina plate having a thickness of 1.0 mm, a width of 10 mm and a length of 240 mm. The alumina plate has a high heat conductivity. The heat generating element 22 is applied through a screen printing process or the like on the bottom surface of the base 21 along the length thereof. It is made of electric resistance material such as Ag/Pd (silver-palladium), for example, and has a thickness of approx. 10 microns and a width of 1-3 mm. The heat generating element 22 is coated with a heat-resistive glass having a thickness of approx. 10 microns as a surface protection layer.

The temperature sensor 23 is, for example, a temperature detecting element applied through a screen printing process on the top surface (opposite from the surface having the heat generating element 22 at the center thereof). It is made of Pt film or the like having a low thermal capacity. The temperature sensor 23 may be in the form of a thermister having a low thermal capacity contacted to the base 21.

In this embodiment, the linear or strap form heat generating member 22 is connected with electric power at the opposite longitudinal ends, so that the heat is generated over the entire length thereof. The power is AC 100 V in this example. In response to the output of the temperature sensor 23, the power supply to the heat generating member is controlled by changing a phase angle of the electric power supplied from an unshown power supply circuit.

The image fixing operation of the apparatus of this embodiment will be described.

Upon an image formation start signal, the image forming apparatus starts to form an image. A visualized toner powder image is formed on the transfer sheet P, and the transfer sheet having the toner image Ta is conveyed from the transfer station 8 to the image fixing apparatus 11. It is introduced along the guide 29 into the nip N formed between the pressing roller 28 and the fixing film 24 urged by the pressing roller toward the heater 20, and is passed through the nip together with the fixing film in contact with the bottom surface of the film without relative movement therebetween and without producing creases.

The heater 20 is energized at predetermined timing from the image formation start signal, so that the toner image Ta is heated at the nip N and is fused into a fused image Tb.

The movement direction of the fixing film 24 abruptly changes by as large as approx. 45 degrees ($=\theta$) at an edge S of the supporting member which has a large curvature (radius of approx. 2 mm). The sheet P which comes through the nip N with the fixing film 24 in contact is separated by the abrupt increase of the curvature from the fixing film 24 at the edge S. It is conveyed to ,the discharge tray 12. By the time the sheet P reaches the discharge tray 12, the toner is sufficiently cooled and solidified so as to be completely fixed on the sheet P into the fixed toner image Tc.

The toner used in this embodiment has sufficiently high viscosity when heated and fused to provide high adherence among toner particles, such that the adherence between the toner and the fixing film 24, even if the temperature of the toner at the time of the separation thereof from the fixing film 24, is higher than the melting point of the toner. For this reason, substantially no toner offset occurs to the fixing film 24 when the sheet is separated from the fixing film 24.

In this embodiment, the thermal capacities of the heat generating element 22 and the base 21 of the heater 20 are small, and are supported by the supporting member with the thermal insulation provided by the supporting member 27, so that the surface temperature of the heater 20 at the nip N rapidly rises to a level sufficiently higher than the toner fusing point (or the fixable temperature relative to the sheet P). Therefore, there is no need of stand-by heating to heat the heater beforehand. Accordingly, energy consumption can be reduced, and temperature rise in the apparatus can be prevented.

The fixing film used in this embodiment will be described. The fixing film 24 is a laminated film having the total thickness of not more than 100 microns, preferably not more than 40 microns and having a heat-resistivity, a parting property and durability or the like.

Figure 4:
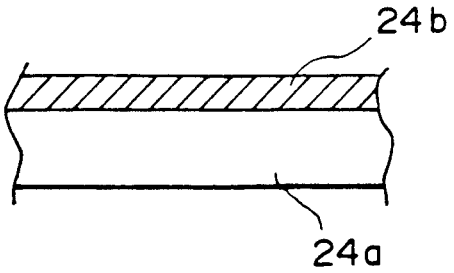
FIG. 4 is a sectional view of an image fixing film used with a heating film apparatus in an embodiment of the present invention.

FIG. 4 shows a cross-section of an example of a laminated film which comprises a heat-resistive layer 24*a* (base layer or film), and a parting layer 24*b* laminated on the outer surface of the heat-resistive layer 24*a* (the side contactable to the toner image).

The heat-resistive layer 24*a* is made of a highly heat resistive resin such as polyimide, polyether ether ketone (PEEK), polyether sulfone (PES), polyether imide (PEI), polyparabanic acid (PPA) or PFA, or metal such as Ni, stainless steel, Al or the like which has good strength and heat resistivity.

The parting layer 24*b* is preferably made of fluorinated resin such as PTFA (polytetrafluoroethylene), PFA or FEP, or silicone resin. The lamination between the heat resistive layer 24*a* and the parting layer 24*b* can be accomplished by bonding, by electrostatic printing (coating), evaporation, CVD or another film forming technique of the material of the parting layer, or by simultaneously extruding the heat resistive material and the parting material.

In this embodiment, the films 24*a* and 24*b* contain conductive materials such as carbon black, graphite or conductive whisker or the like, by which the volume resistivity of the surface of the fixing film 24 is decreased. As a result, the charging of the toner contactable surface of the fixing film 24 can be prevented. When the toner contactable surface of the fixing film 24 is insulative, the surface of the fixing film is electrically charged with the result that the toner image on the sheet P is disturbed, or the toner image is transferred onto the fixing film 24 (so-called "charge off-set"). These problems are solved by the present embodiment. In addition, the triboelectric charging resulting from the sliding between the film and the heater 20 can be prevented.

In order to reduce the amount of electric charge of the entire film, as shown in FIG. 1, the driving roller 25 is made of electrically conductive material, and is electrically grounded through an electrically conductive bearing 41 or a slidable electrode contact and through a varistor 42, by which the film can be maintained substantially at a predetermined potential level.

Particularly, by grounding it through the varistor, the triboelectric charge of the film and the heater are effectively utilized to maintain the predetermined potential of the film without the necessity of a particular electric source.

Because the apparatus of this embodiment has the structure described above, the film 24 is prevented from electrically charging, so that the leakage or the charge off-set attributable to the charge-up of the film can be prevented.

Figure 8:
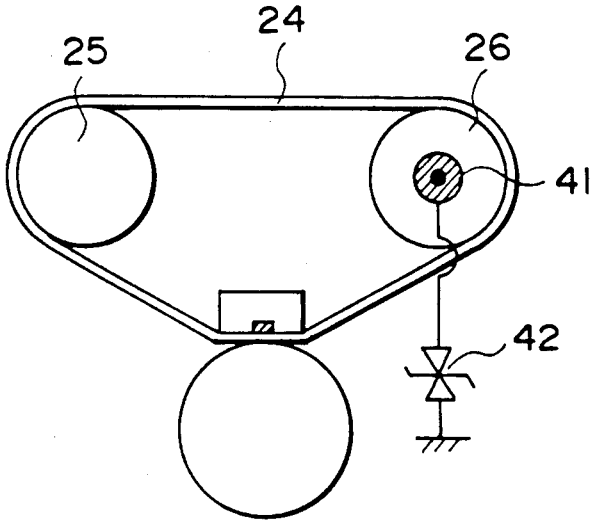

Referring to FIG. 8, there is shown an apparatus according to another embodiment of the present invention wherein the follower roller 26 is made of electrically conductive material.

Figure 9:
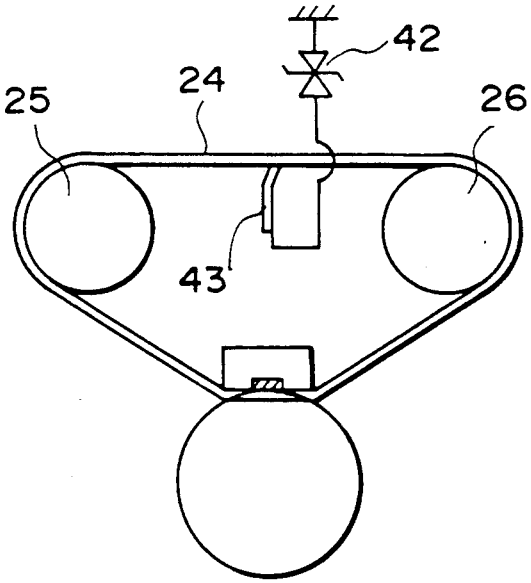

FIG. 9 shows an embodiment wherein an electrically conductive brush 43 is used.

In these embodiments, no additional member is contacted to the inside of the film 24, and therefore, the outer surface of the film 24 is not damaged, by which the durability of the film is better than the case wherein a brush is contacted to the surface of the film.

Figure 3:
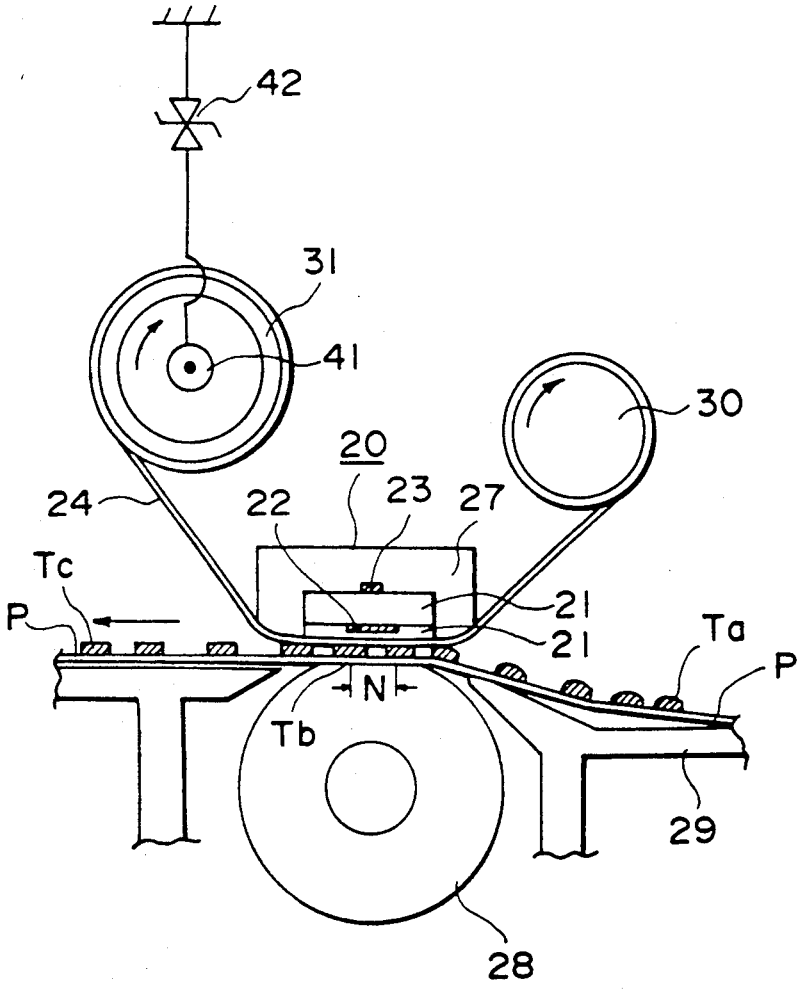
FIGS. 3, 5, 6, 7, 8 and 9 are sectional views of the image fixing apparatuses according to other embodiments of the present invention.

The fixing film 24 in not limited to an endless belt, but may be a non-endless belt wrapped on a supply shaft 30 and on a take-up shaft 31 through the nip formed between the heater 20 and the pressing roller 28, as shown in FIG. 3. The film 24 in this form is moved from the supply shaft 30 side to the take-up shaft 31 side at the same speed as the transfer material conveying speed.

The take-up shaft 31 is made of electrically conductive material and is grounded through a conductive member 41 and a varistor 42.

Figure 5:
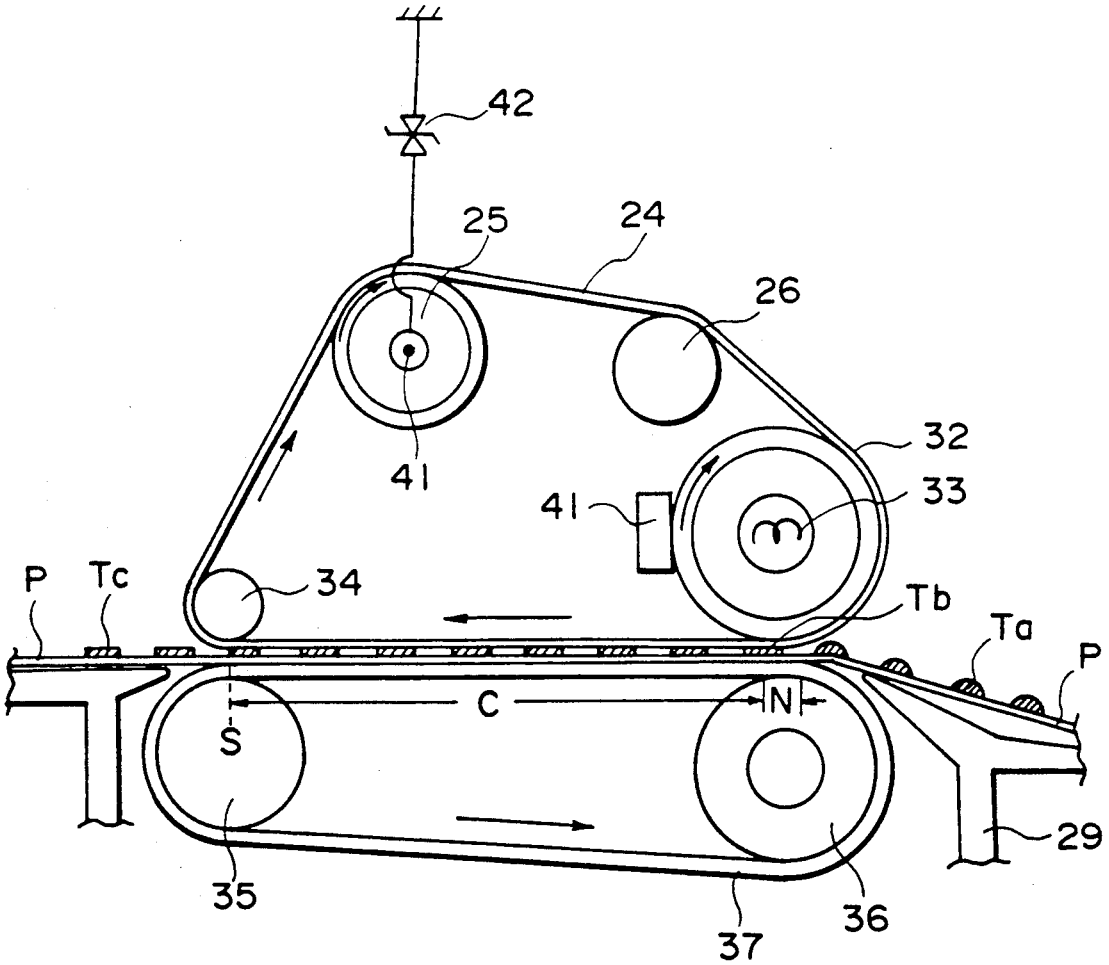

FIG. 5 shows an image fixing apparatus as an exemplary heating apparatus according to a further embodiment of the present invention.

Designated by a reference numeral 32 is a heating roller (heating member) and contains a heater 33 which is energized in accordance with the surface temperature of the heating roller detected by a temperature sensor 41, so that the surface temperature of the heating roller 32 is maintained at a predetermined temperature level.

The fixing apparatus comprises an upper separation roller 34 having a small diameter and disposed downstream of the a heating roller 32 with respect to the conveyance direction of the sheet P, a driving roller 25 for rotationally traveling the fixing film, and a follower or driven roller 26 for applying proper tension at all times to the fixing film. The driving roller 25 and the driven roller 26 are rotated in the clockwise direction at the same speed as the sheet conveyance speed.

An image fixing film 24 is stretched around four parallel members 32, 34, 25 and 26.

The apparatus further comprises a pressing roller 36 disposed below the heating roller 32, a lower separation roller 35 disposed below a the upper roller 34, a conveyer belt (back-up belt) 37 in the form of an endless belt stretched around the pressing roller 36 and the lower separation roller 35. The pressing roller 36 has a surface layer made of elastic material such as silicone rubber. Between the pressing roller 36 and the heating roller 32, the bottom travel of the endless fixing film 24 is sandwiched, and the total pressure of 4–7 kg is applied by an unshown urging means.

When the heating roller 32 is rotationally driven, the pressing roller 36 rotates, by which the conveyer belt 37 rotates in the counterclockwise direction at the same speed as the sheet conveyance speed, while press-contacting the sheet P to the fixing film 24.

In operation, upon an image formation start signal, the image forming apparatus starts to form an image. A visualized unfixed toner image is formed on the transfer sheet P, and thereafter the transfer sheet having the toner image Ta is conveyed from the transfer station 8 to the image fixing apparatus 11. It is introduced along the guide 29, while the fixing film 24 and the conveyer belt 37 are rotated, into the nip N formed between the pressing roller 36 and the fixing film 24 urged by the pressing roller toward the heating roller 32, and is passed through the nip together with the fixing film in contact with the bottom surface of the film without relative movement therebetween and without producing creases.

During the passage through the nip N, the toner image Ta is heated and fused into a fused image Tb.

The portion of the sheet having passed through the nip N between the pressing roller 36 and the heating roller 32, continues to be conveyed in close contact with the fixing film stretched between the heating roller 32 and the upper separation roller 34, before the portion reaches to the upper separation roller 34. The conveyer belt 37 supports the backside of the sheet P to maintain the close-contactness between the sheet P and the fixing film 24. During the conveyance process, the sheet of the soften/fused toner image Tb is radiated, by which a cooled/solidified toner image Tc is produced. The heat radiation in this radiation and cooling process is provided by the spontaneous radiation in this embodiment. However, a forced cooling may be employed with the use of a heat radiation fins or with the use of a fan.

When the portion reaches the upper separation roller 34, the fixing film 24 is deflected along the upper separation roller 34 having a large curvature away from the sheet P surface, by which the fixing film 24 and the sheet P are separated from each other. Then, the sheet P is conveyed to the discharging tray 12. By the time of the separation, the toner is sufficiently cooled and solidified, so that the adherence of the toner to the sheet P is sufficiently large, whereas the adherence of the toner to the fixing film 24 is very small, so that the separation between the fixing film 24 and the sheet P is performed substantially without toner offset to the fixing film 24.

According to this embodiment, the set temperature of the heater may be increased to a higher degree than in the conventional heating roller type fixing system. By the increase of the temperature, the fixing performance is enhanced. In addition, the tolerable temperature range of the heater is larger at the high temperature side, so that the temperature control system is easy.

In addition, when the toner images of different colors, particularly three or more different color toners are fixed together (color mixture), the toner can be fused at a high temperature, and therefore, producing good color mixture. In addition, since the fused toner is cooled and solidified while being in contact with the fixing film, and thereafter separated from the fixing film, the surface of the toner image follows the surface property of the fixing film. Therefore, if the fixing film is given a smooth surface, the surface of the toner image Tc can be as glossy as a silver salt photograph.

By reducing the thickness of the fixing film 24, the heat accumulation in the fixing film can be prevented, by which the cooling efficiency of the toner image is improved. Where the fixing film is made of thin resin, the contactness with the toner image is improved, so that the heat transfer efficiency is further improved.

Figure 6:
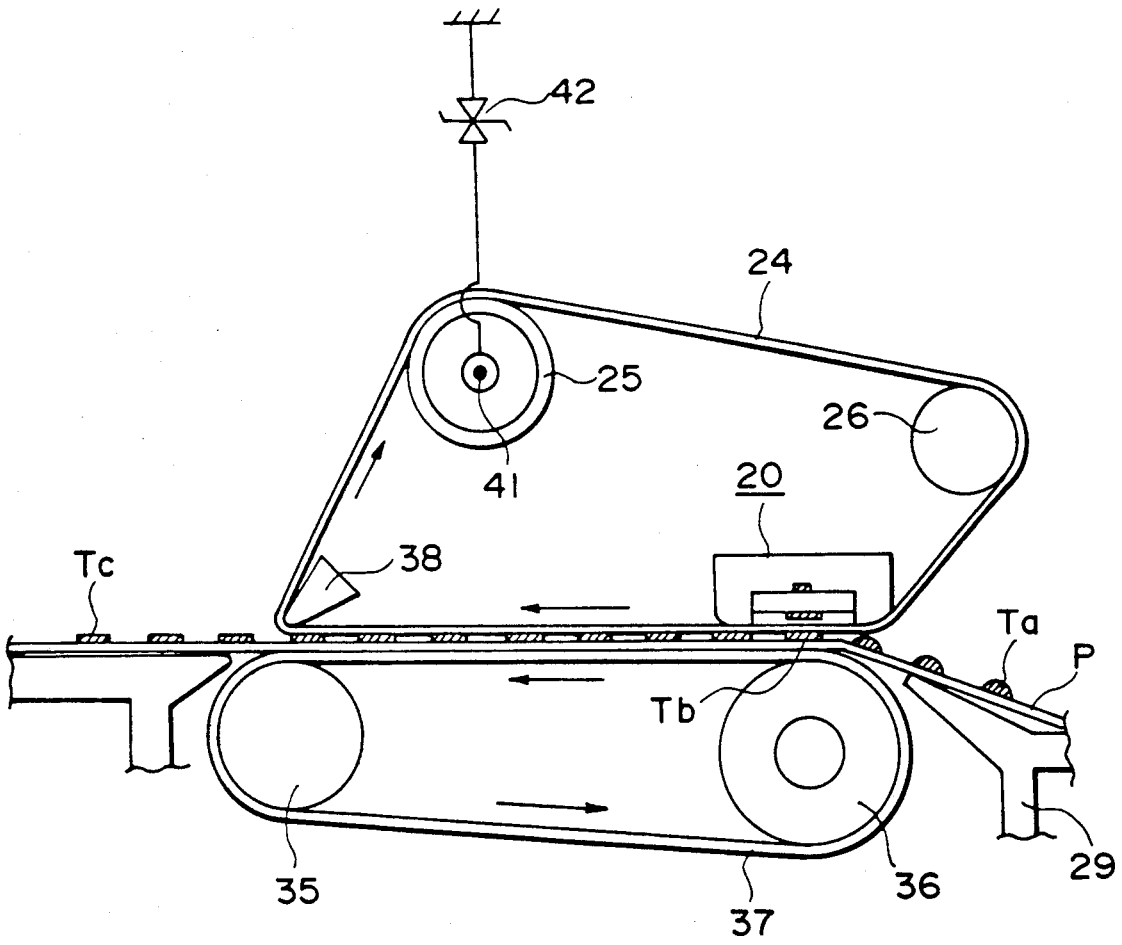

The heater 32 is not limited to the form of the heating roller, but may be a fixed heater 20 of the first embodiment, as shown in FIG. 6. In this case, in addition to the above-described advantageous effects, the thermal capacities of the heat generating element 22 and the base plate 21 are small, and are thermally isolated, by which the temperature rising speed is high with the advantage of eliminating the necessity of the stand-by temperature control.

In place of the upper separation roller 34, a separation stay 38 having a further large curvature edge may be disposed, by which the sheet P can be separated from the fixing film 24 with increased certainty.

Figure 7:
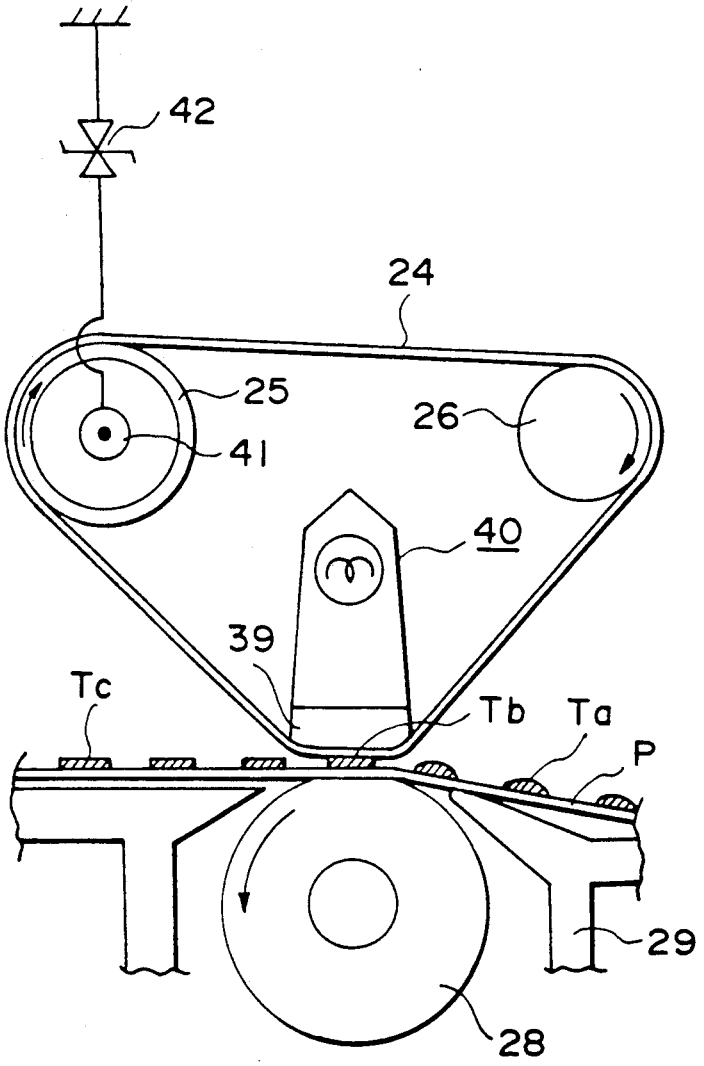

FIG. 7 shows an image fixing apparatus according to a yet further embodiment of the present invention.

In place of the heater 20 of the first embodiment (FIG. 1), a transparent member made of heat resistive glass or the like is disposed, through which the toner image is heated by a heat radiation source 40 such as halogen lamp disposed inside the endless fixing film 24.

According to this embodiment, the toner image is heated by radiation, so that the toner can be instantaneously heated and fused. Therefore, the toner image is heated only while the sheet P is present in the nip N, whereby the power consumption can be reduced with the advantageous effect of no temperature rise in the apparatus.

In any of the above cases, the film 24 is prevented from being electrically charged, so that leakage and charge offset can be prevented.

As described in the foregoing, according to the embodiments of the present invention, the volume resistivities of the layers constituting the heating film is not more than $10^{11}$ ohm.cm, and the charge accumulated on the film is released through a member contacted to film, so that leakage or charge off-set attributable to the charge-up of the film can be prevented.

While the invention has been described with reference to the structures disclosed herein, it is not confined to the details set forth and this application is intended to cover such modifications or changes as may come within the purposes of the improvements or the scope of the following claims.

What is claimed is:

1. A heating apparatus for heating a visualized image on a recording material, comprising:

a heater;

a movable resin film comprising a first layer having a surface contactable to said heater, and a second layer having a surface contactable to the recording material, wherein the surface of said second layer is in contact with the recording material at a position of said film where the surface of said first layer is in contact with said heater;

wherein said layers each have a volume resistivity of no more than $10^{11}$ ohm.cm; and connecting means for electrically grounding said first layer of said film.

2. An apparatus according to claim 1, wherein said heater is stationary in use, and the surface of said first layer is in sliding contact with said heater, and is electrically grounded.

3. An apparatus according to claim 1, wherein said heater is stationary in use, and the surface of said first layer is in sliding contact with said heater, wherein said first layer is electrically grounded through a constant voltage element.

4. An apparatus according to claim 1, wherein said heater is stationary in use, and the surface of said first layer is in sliding contact with said heater, wherein said first layer comprises a heat-resistive resin containing electrically conductive material.

5. An apparatus according to claim 1, wherein said second layer comprises a fluorinated resin material containing electrically conductive material.

6. An apparatus according to claim 1, wherein said film is in the form of an endless belt.

7. An apparatus according to claim 1, wherein said film has a total thickness of no more than 100 microns.

8. An apparatus according to claim 1, wherein said film has a total thickness of no more than 40 microns.

9. An apparatus according to claim 1, wherein said heater comprises a linear heat generating resistor layer extending in a direction perpendicular to a movement direction of said film and a highly thermally conductive base plate for supporting said heat generating resistor layer.

10. An apparatus according to claim 1, further comprising a pressing member for urging said film and the recording material toward said heater.

11. A heating apparatus for heating a visualized image on a recording material, comprising:

a heater which is stationary in use;

a movable film having a first surface layer for sliding contact with said heater, and a second surface layer for contacting the recording material having the visualized image;

wherein, said first surface layer and second surface layer are resin layers, wherein said second surface layer is a low resistance layer containing electrically conductive material; and wherein said second surface layer is electrically grounded through a constant voltage element.

12. An apparatus according to claim 11, wherein said constant voltage element is a varistor.

13. An apparatus according to claim 11, wherein said second surface layer comprises a fluorinated resin.

14. An apparatus according to claim 11, wherein said film is in the form of an endless belt.

15. An apparatus according to claim 11, wherein said film has a total thickness of no more than 100 microns.

16. An apparatus according to claim 15, wherein said film has a total thickness of no more than 40 microns.

17. An apparatus according to claim 11, wherein said heater has a linear heat generating resistor layer extending in a direction perpendicular to a movement direction of said film ad a highly thermally conductive base plate for supporting the heat generating resistor layer.

* * * * *

UNITED STATES PATENT AND TRADEMARK OFFICE

CERTIFICATE OF CORRECTION

PATENT NO. : 5,115,278

DATED : May 19, 1992

INVENTOR(S) : MARUTA et al.

It is certified that error appears in the above-identified patent and that said Letters Patent is hereby corrected as shown below:

COLUMN 3
Line 20, "in," should read --in--.

COLUMN 4
Line 19, "thermister" should read -- thermistor--.

COLUMN 5
Line 12, "will be" should read --will now be--.

COLUMN 6
Line 33, "a" should be deleted.
Line 44, "a" (first occurrence) should be deleted.

COLUMN 7
Line 44, "therefore," should read --therefore--.
Line 56, "contactness" should read --contact--.

COLUMN 8
Line 24, "to film," should read --to the film,--.

UNITED STATES PATENT AND TRADEMARK OFFICE

CERTIFICATE OF CORRECTION

PATENT NO. : 5,115,278

DATED : May 19, 1992

INVENTOR(S) : MARUTA, ET AL

It is certified that error appears in the above-identified patent and that said Letters Patent is hereby corrected as shown below:

Column 10, line 18, "ad" should read --and--.

Signed and Sealed this

Thirty-first Day of August, 1993

Bruce Lehman

*Attest:*

BRUCE LEHMAN

*Attesting Officer*

*Commissioner of Patents and Trademarks*